US006168020B1

(12) United States Patent
Niedzwiedz

(10) Patent No.: US 6,168,020 B1
(45) Date of Patent: Jan. 2, 2001

(54) RECLOSABLE SLEEVE PACKAGE

(75) Inventor: Scott Alan Niedzwiedz, Porter, IN (US)

(73) Assignee: Cooper Automotive Products, Inc., Houston, TX (US)

( * ) Notice: Under 35 U.S.C. 154(b), the term of this patent shall be extended for 611 days.

(21) Appl. No.: 08/531,087

(22) Filed: Sep. 20, 1995

(51) Int. Cl.[7] ..... B65D 73/00; B65D 85/00
(52) U.S. Cl. ..... 206/468; 206/335; 206/806
(58) Field of Search ..... 206/461, 467, 206/468, 806, 335, 462, 469

(56) References Cited

U.S. PATENT DOCUMENTS

| | | | | |
|---|---|---|---|---|
| 2,577,862 | * | 12/1951 | Shaw, Jr. | 206/806 X |
| 3,217,867 | | 11/1965 | Harris . | |
| 3,367,491 | | 2/1968 | Dunham et al. . | |
| 3,382,972 | | 5/1968 | Phipps . | |
| 3,530,978 | * | 9/1970 | Lewandowski | 206/468 |
| 3,812,963 | | 5/1974 | Zahuranec et al. . | |
| 4,091,927 | | 5/1978 | Lunsford . | |
| 4,119,203 | | 10/1978 | Kuchenbecker . | |
| 4,120,400 | | 10/1978 | Kotyuk . | |
| 4,305,504 | | 12/1981 | Bredal . | |
| 4,415,084 | | 11/1983 | Hauser et al. . | |
| 4,854,450 | * | 8/1989 | Fisher | 206/469 |
| 5,027,947 | | 7/1991 | Reighart . | |
| 5,154,293 | | 10/1992 | Gould . | |
| 5,379,896 | | 1/1995 | Snow et al. . | |

* cited by examiner

*Primary Examiner*—Bryon P. Gehman
(74) *Attorney, Agent, or Firm*—Reising, Ethington, Barnes, Kisselle, Learman & McCulloch, P.C.

(57) ABSTRACT

A reclosable sleeve package that includes a container and a sleeve which slides freely over the container. The container has a tab at one end, a space to hold a commercial article at the other end, and an opening along a portion of the container to allow the commercial article to be placed in and removed from the container. The tab contains an aperture to enable the package to be hung on a display rack. The sleeve has an opening at one end which allows the sleeve to slide over the container. The sleeve fits over the tab end of the container and covers the opening in the container. The other end of the sleeve contains an enclosure which covers the tab end of the container including a portion of the tab. The enclosure has a slot which exposes the aperture in the tab and a portion of the tab when the sleeve is in place on the container. The slot is such that would require the package to be hung on a display rack only by the aperture in the tab and not from the sleeve.

20 Claims, 5 Drawing Sheets

RECLOSABLE SLEEVE PACKAGE

BACKGROUND OF THE INVENTION

A. Field of the Invention

The present invention relates to reclosable packages. In particular, the present invention relates to reclosable sleeve packages.

B. Description of Related Art

Windshield wipers are mainly sold as after-market replacement parts in auto supply shops, service stations, and other retail outlets. Industry practice typically allows a customer to purchase the wipers on condition that the wipers fit the customer's vehicle. Frequently, the customer buys the wrong windshield wiper, but only realizes the error after opening the wiper package. In that case, the customer returns the opened package for a refund. Once opened, however, the package is often mutilated, which makes the windshield wiper unsalable because other customers are unwilling to buy the same wipers in damaged packages. Thus, several reclosable packages for windshield wipers have been developed.

One type of reclosable package is described in U.S. Pat. No. 5,027,947 to Reighart. As shown in FIGS. 1A and 1B, the Reighart package includes a hollow container 20 to hold a windshield wiper and a sleeve 40 which slides over the container 20. A portion 29 of the back of the container 20 is left open to allow for removal or replacement of the wiper. The container 20 also has a tab 50 attached to the top 22 of the container 20. The tab 50 contains an aperture 51 which is used to hang the container 20 on a display rack.

The sleeve 40 slides over the top 22 of the container 20 and is used to cover the opening 29 in the container 20 during shipment and display. The sleeve 40 is constructed and arranged to expose the aperture 51 in the tab 50 when the sleeve 40 covers the opening 29 in the container 20.

This prior art embodiment of the sleeve 40 has an enclosure 42 over the tab 50. The enclosure 42 contains two apertures 41 which align with the tab aperture 51 when the sleeve 40 is placed on the container 20 to cover the opening 29 in the container 20.

However, a problem arises when the apertures 41 in the sleeve 40 and the aperture 51 in the tab 50 are not aligned. A salesperson or customer may unknowingly hang the package only from the apertures 41 in the sleeve 40 and not the aperture 51 in the tab 50. In which case, the container 20 falls out of the sleeve 40 and fails to stay on the display rack.

Attempts to solve this problem have been made without success. One attempt has been to increase the interference between the sleeve 40 and the container 20 to ensure that the container 20 would not fall out of the sleeve 40 if the package were hung only from the sleeve 40. The interference, however, limits the ease with which the sleeve 40 is placed on the container 20. Thus, this attempt has had limited success.

Therefore, a need exists in the art for a reclosable sleeve package that does not require careful alignment of the apertures in the sleeve and the aperture in the tab before hanging, that has limited interference between the sleeve and the container, and that prevents the container from falling out of the sleeve when hung.

OBJECTS AND SUMMARY

Accordingly, an object of the present invention is to provide for a reclosable sleeve package that overcomes the problems associated with prior art reclosable sleeve packages and where careful alignment of apertures in the sleeve and the tab is unnecessary.

A further object of the present invention is to provide for a reclosable sleeve package where the sleeve slides freely and easily over the container.

A further object of the present invention is to provide for a reclosable sleeve package where the container does not fall out of the sleeve when the package is hung on a display rack.

A further object of the present invention is to provide for a method for assembling a product having a reclosable sleeve package of the present invention.

These and other objects of the invention will be more readily understood by reference to the following summary, detailed description of the preferred embodiments of the invention, and the appended drawings.

The present invention achieves all of the foregoing objects and solves the problems associated with prior art reclosable sleeve packages. In particular, the present invention relates to a reclosable package that includes a container and a sleeve which slides freely over the container. The container has a tab at one end, a space or cavity to hold a commercial article at the other end, and an opening along a portion of the container. This opening is in communication with the space in the container to allow the commercial article to be placed in and removed from the container. The tab contains an aperture to enable the package to be hung on a display rack.

The sleeve has an opening at one end which allows the sleeve to slide easily over the container. The sleeve fits over the tab end of the container and covers the opening in the container when the sleeve is in place on the container. The other end of the sleeve contains an enclosure which covers the tab end of the container including a portion of the tab. The enclosure has a slot or cutout which exposes the aperture in the tab and a portion of the tab when the sleeve is in place on the container. The slot or cutout is such that would require the package to be hung on a display rack by the aperture in the tab and not allow the package to be suspended from the sleeve. During hanging of the package, the sleeve rests on the container.

The present invention also includes a method for assembling a product having a reclosable sleeve package of the present invention.

DESCRIPTION OF THE PREFERRED EMBODIMENTS

Figures 1A, 1B:
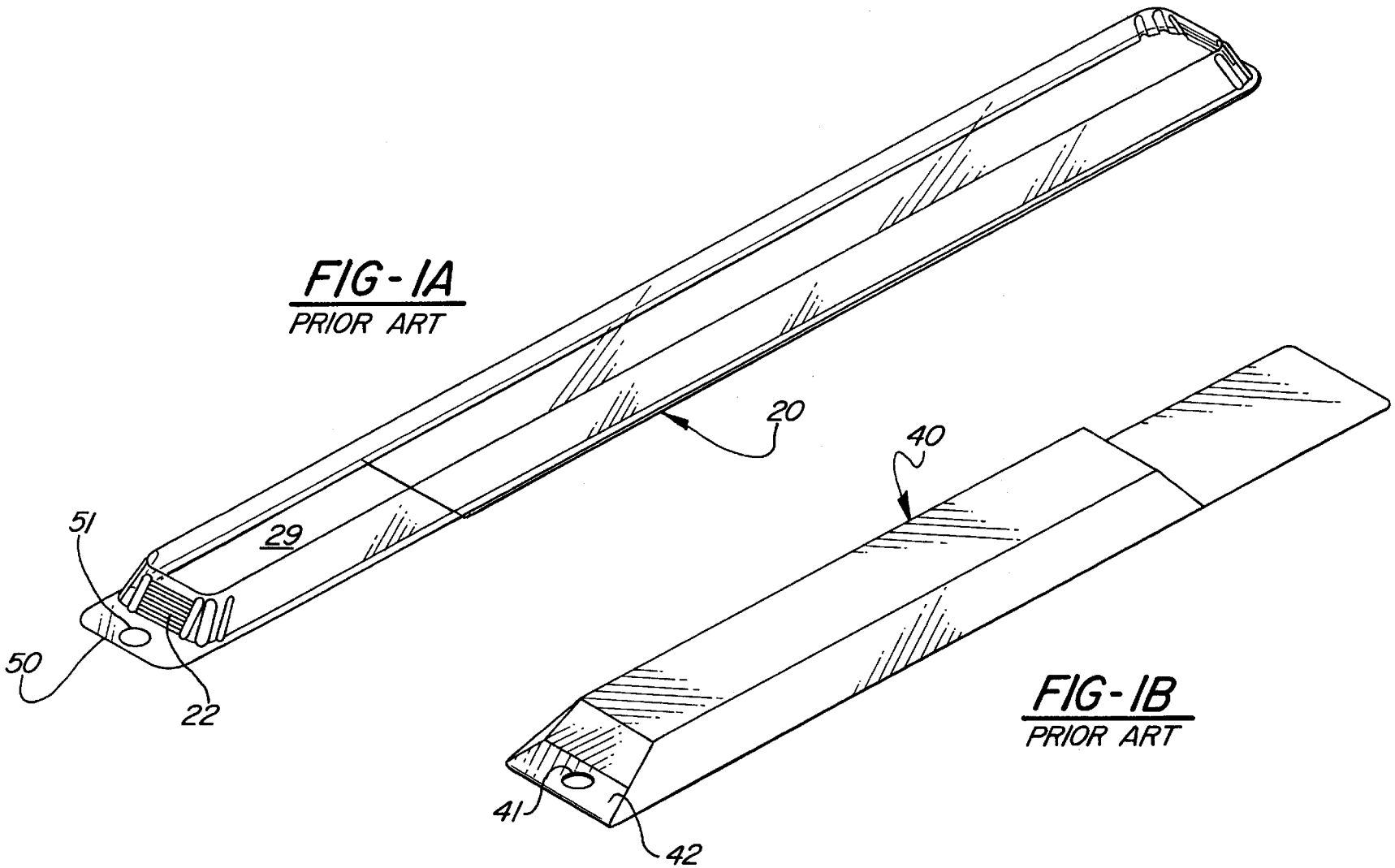
FIG-1A PRIOR ART
FIG-1B PRIOR ART
FIGS. 1A and 1B show a container and a sleeve, respectively, making up a prior art reclosable sleeve package.
Figure 2:
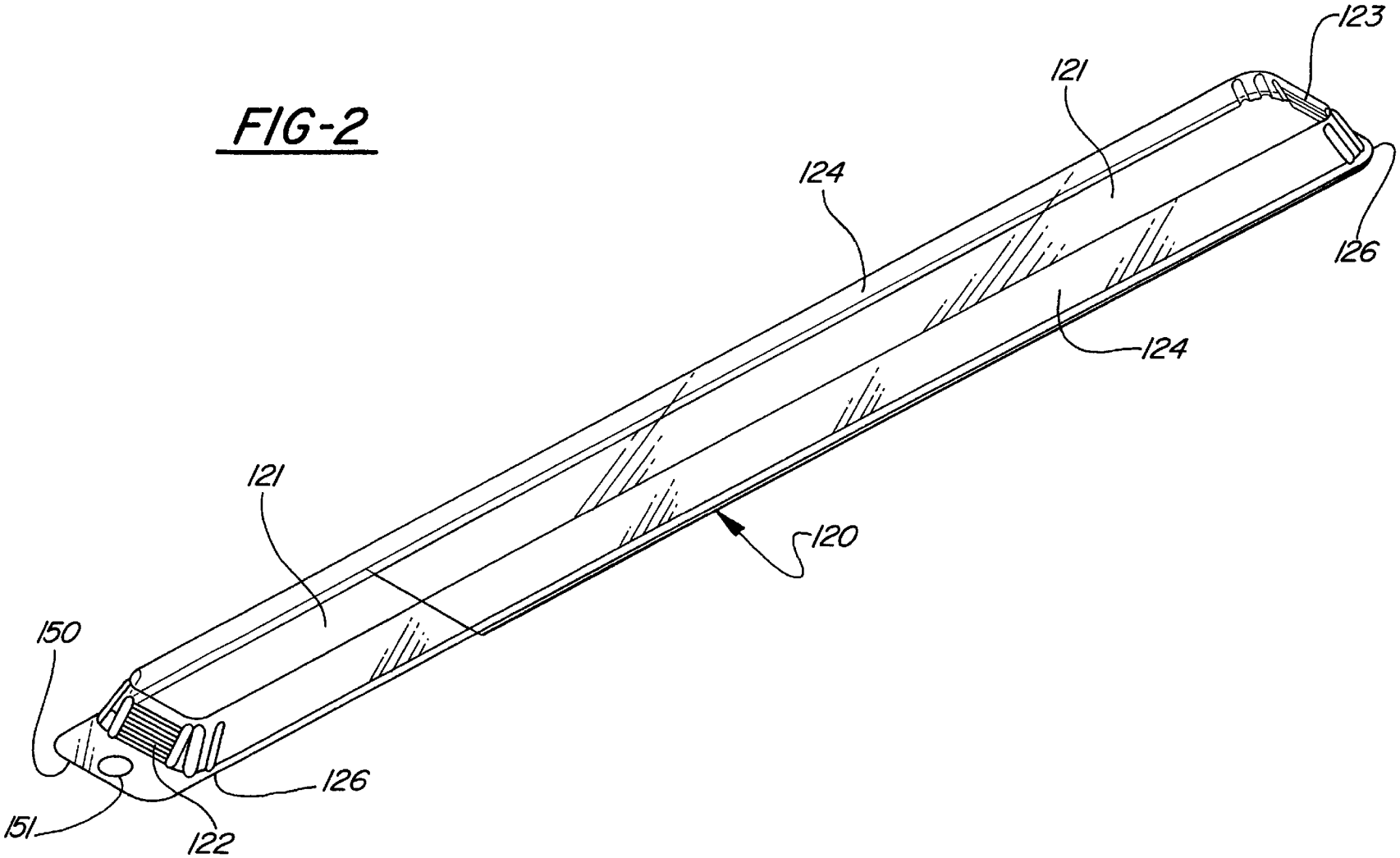
FIG. 2 is a top-side perspective of a container of the present invention.

A container 120 of the present invention is shown in FIG. 2. The container 120 may be constructed of any packaging material. Typical packaging materials that would be suitable for the present invention include clear plastic, cardboard, and nonclear plastic. Clear plastic is the most preferred container material. The container 120 has a three-dimensional configuration. The container 120 has a front 121, a top 122, a bottom 123, and two sides 124. The container 120 may have a flange 126 extending from the two sides 124 and the bottom 123.

The container 120 also has a tab 150 extending from the top 122. The tab 150 contains an aperture 151. The aperture 151 is used to hang the package 100 (FIGS. 6A and 6B) on a hook. The aperture 151 may be of any shape or size so long as it is sufficient to hold the package 100 on the hook.

Figure 3:
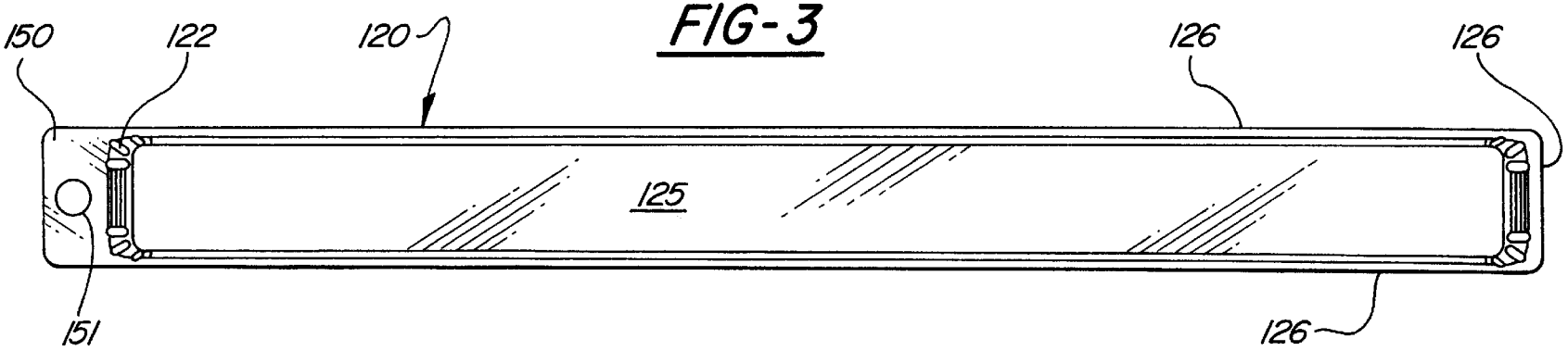
FIG. 3 is a back plan view of a container of the present invention.

FIG. 3 represents a back view of the container 120. The container 120 has a space 125 or cavity of sufficient size to completely contain a commercial article. The commercial article is preferably a windshield wiper. The container 120 may have several compartments (not shown) within the space 125 to enclose several commercial articles. Suitable commercial articles would include a windshield wiper assembly having several different parts.

Figure 4:
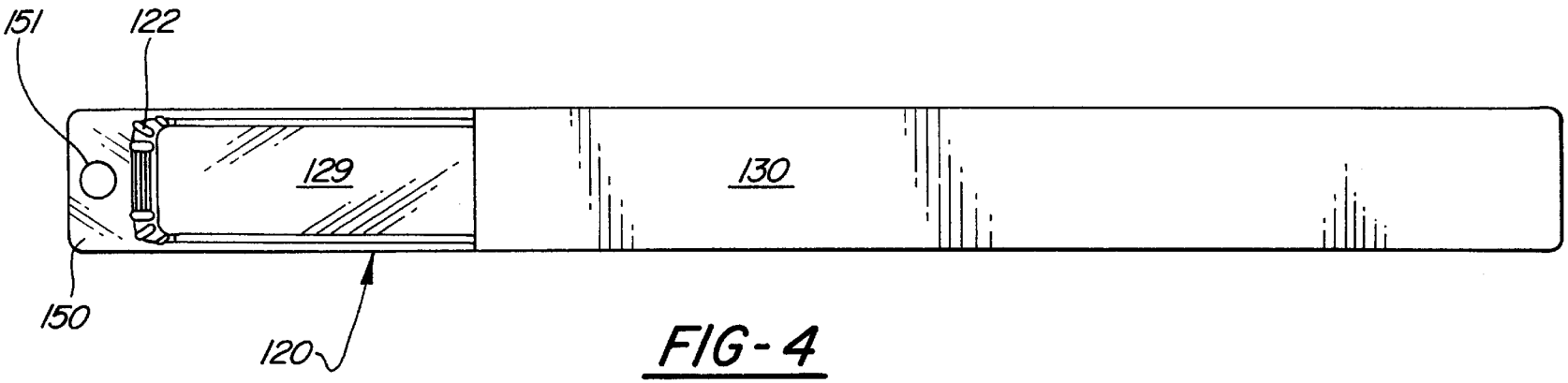
FIG. 4 is a back plan view of a container of the present invention with a backing section.

FIG. 4 depicts a back view of the container 120 with a backing section 130. The backing section 130 is attached to the container 120 and encloses a portion of the container. If the container 120 has a flange 126, the backing section 130 is preferably attached to the flange 126. The backing section 130 may be constructed of any packaging material and may be the same or different material from the container 120. Suitable backing section materials include clear plastic, cardboard, and nonclear plastic. Nonclear plastic is the most preferred backing section material. A portion 129 of the container 120 is left open. This opening 129 or removal area is in communication with the container space 125. The opening 129 allows for the commercial article to be placed in and removed from the container 120 without damaging the container 120. If the container 120 has several compartments, the backing section 130 may have several openings (not shown) or gaps in which to access the compartment spaces.

Figure 5:
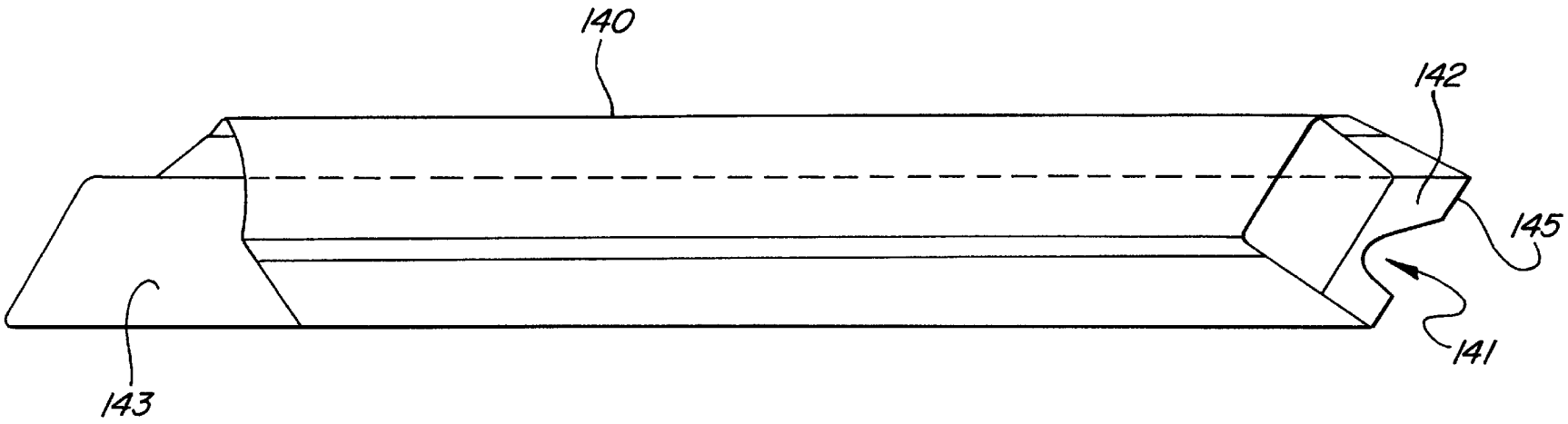
FIG. 5 is a top front-side perspective of a sleeve of the present invention.

A sleeve 140 of the present invention is shown in FIG. 5. The sleeve 140 may be constructed of any packaging material. Suitable sleeve materials include clear plastic, cardboard, and nonclear plastic. The most preferred sleeve material is cardboard. The sleeve 140 has an opening 143 on one end to receive the container 120.

On the other end of the sleeve 140 is an enclosure 142 or pocket which fits over and covers the top 122 of the container 120. The enclosure 142 covers a portion of the tab 150 as well. Preferably, the enclosure 142 or pocket has a reduced depth compared to the rest of the sleeve 140. Most preferably, the enclosure 142 has the same shape as, but slightly larger dimensions than the container top 122 and tab 150.

The enclosure 142 has a slot 141 or cutout to expose the aperture 151 in the tab 150 and a portion 152 (FIGS. 6A and 6B) of the tab 150. The slot 141 can be of any shape or size such that it would require the package 100 to be hung on a display rack from the aperture 151 in the tab 150 rather from the sleeve 140, thus preventing the container 120 from falling out of the sleeve 140. Preferably, the slot 141 or cutout extends to the edge 145 of the enclosure 142. The preferred shape of the slot 141 is V-shaped or U-shaped. The most preferred shape of the slot 141 is V-shaped.

The sleeve 140 should be long enough to cover the opening 129 in the container 120. If the container 120 has several compartments and several openings, then the sleeve 140 should be long enough to cover all the openings.

In order to work in a sliding relationship with the container 120, the sleeve 140 should be slightly larger than the width and depth of the container 120. Clearance between the sleeve 140 and container 120 should be such that the sleeve may be removed from the container without damage to either, yet allow the sleeve 140 to remain snug against the container 120 without the aid of additional fasteners. The sleeve 140 should slide easily, freely, and without interference on and off the container 120.

Figure 6B:
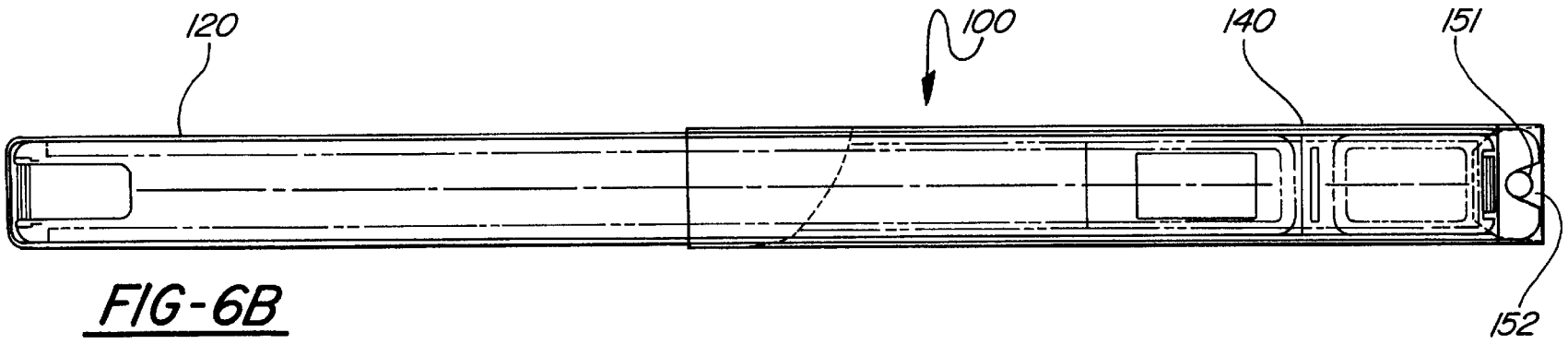
FIGS. 6A and 6B represent a front and back view, respectively, of a reclosable sleeve package of the present invention with the sleeve over the container.
Figure 6A:
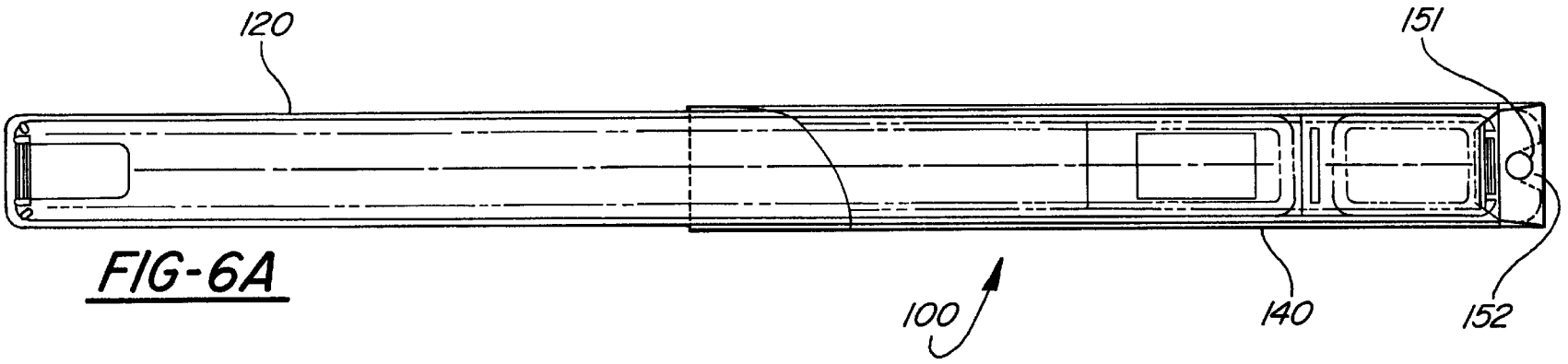

FIGS. 6A and 6B show the front and back view, respectively, of a reclosable sleeve package 100 of the present invention. When the sleeve 140 is in place over the tab end of the container 120, the aperture 151 in the tab 150 and a portion 152 of the tab 150 are visible through the slot 141 on the enclosure end of the sleeve 140.

The present invention further relates to a method for assembling a product having a reclosable sleeve package 100. The method involves placing a commercial article into a hollow container 120 having an opening 129 for removing and returning the article without damaging the container 120. The container 120 has a tab 150 extending from one end of the container 120. The tab 150 has an aperture 151 for hanging the package 100 on a hook. The process further involves sliding a sleeve 140 over the tab end of the hollow container 120 to cover the opening 129. The sleeve 140 has an opening 143 at a first end to receive the hollow container 120 and an enclosure 142 at a second end to cover the tab end of the hollow container 120 and a portion of the tab 150. The enclosure 142 has a slot 141 which preferably extends to the edge 145 of the enclosure 142 to expose the aperture 151 and a portion 152 of the tab.

Other variations and modifications to the preferred embodiments described herein are intended to be encompassed by the true spirit and scope of the invention. This true spirit and scope are defined by the appended claims to be interpreted in light of the foregoing specification.

What is claimed is:

1. A reclosable package, comprising:

a container having a three dimensional configuration, a tab at a first end thereof, a space for containing a product at a second end thereof, an opening in communication with the space to allow the product to be placed in and removed from the space in the container;

a sleeve having an opening at a first end thereof that fits over the first end of the container to cover the opening in the container when the sleeve is in place on the container, and an enclosure at a second end thereof that covers the first end of the container and a portion of the tab;

the tab of the container having an aperture to enable the package to be hung on a hook;

the enclosure of the sleeve having a slot exposing the aperture in the tab and a portion of the tab when the sleeve is in place on the container; and the slot extending to an edge of the enclosure so that when the package is hung on a hook while the sleeve is in place on the container, the package is supported only by engagement of the hook with the aperture in the tab, and is not supported by the sleeve, wherein the enclosure covers a portion of the tab located along a line that extends through the aperture, the line being substantially horizontal when the package is hung from the hook.

2. A reclosable package according to claim 1, wherein the slot is V-shaped.

3. A reclosable package according to claim 1, wherein the slot is U-shaped.

4. A reclosable package according to claim 1, wherein the container is made of a material from the group consisting of clear plastic, cardboard, and nonclear plastic.

5. A reclosable package according to claim 4, wherein the container is made of clear plastic.

6. A reclosable package according to claim 4, wherein the sleeve is made of a material from the group consisting of clear plastic, cardboard, and nonclear plastic.

7. A reclosable package according to claim 6, wherein the sleeve is made of cardboard.

8. A reclosable package according to claim 1, wherein the product is a windshield wiper.

9. A reclosable package according to claim 1, wherein the space has at least one compartment, the container has at least one opening in communication with the at least one compartment, and the sleeve covers the at least one opening.

10. A reclosable package, comprising:

a hollow container having a front, a back, a top, a bottom, and two sides, said hollow container constructed and arranged to contain a product;

a backing section constructed and arranged to cover a portion of said back leaving a removal area in proximity to said top of said hollow container;

a sleeve, constructed and arranged to slide over said top of said hollow container, said sleeve covering said removal area in said hollow container in a sliding relationship, whereby said reclosable package is undamaged when said product is removed from or returned to said hollow container through said removal area; and a tab extending from said top of said hollow container, said tab including an aperture for hanging said package;

said sleeve having a pocket at one end thereof for receiving said tab and for covering a portion of said tab, said pocket having a slot therein to expose said tab aperture and a portion of said tab when the sleeve is in place on the hollow container, said slot extending to an edge of the pocket so that the sleeve does not support the package when the package is hung, wherein the pocket covers a portion of the tab located along a line that extends through the aperture, the line being substantially horizontal when the package is hung from the hook.

11. A reclosable package according to claim 10, wherein said slot is V-shaped.

12. A reclosable package according to claim 10, wherein said slot is U-shaped.

13. A reclosable package according to claim 10, wherein said pocket has a reduced depth compared to a rest of the sleeve.

14. A reclosable package according to claim 10, wherein said hollow container is made of a material from the group consisting of clear plastic, cardboard, and nonclear plastic.

15. A reclosable package according to claim 14, wherein said container is made of clear plastic.

16. A reclosable package according to claim 14, wherein the sleeve is made of a material from the group consisting of clear plastic, cardboard, and nonclear plastic.

17. A reclosable package according to claim 16, wherein said sleeve is made of cardboard.

18. A reclosable package according to claim 16, wherein the backing section is made of a material from the group consisting of clear plastic, cardboard, and nonclear plastic.

19. A reclosable package according to claim 18, wherein said backing section is made of nonclear plastic.

20. A reclosable package according to claim 10, wherein the product is a windshield wiper.

* * * * *